US005564916A

United States Patent [19]

Yamamoto et al.

[11] Patent Number: 5,564,916

[45] Date of Patent: Oct. 15, 1996

[54] ROTARY COMPRESSOR HAVING STRENGTHENED PARTITION AND SHAPED RECESSES FOR RECEIVING THE STRENGTHENED PARTITION

[75] Inventors: Yasushi Yamamoto; Masanori Masuda; Takahiro Uematsu, all of Sakai, Japan

[73] Assignee: Daikin Industries, Ltd., Japan

[21] Appl. No.: 362,570

[22] PCT Filed: Apr. 11, 1994

[86] PCT No.: PCT/JP94/00606

§ 371 Date: Jan. 6, 1995

§ 102(e) Date: Jan. 6, 1995

[87] PCT Pub. No.: WO94/27051

PCT Pub. Date: Nov. 24, 1994

[30] Foreign Application Priority Data

May 11, 1993 [JP] Japan ..... 5-109628

[51] Int. Cl.[6] ..... F04C 18/04

[52] U.S. Cl. ..... 418/1; 418/66

[58] Field of Search ..... 418/66, 67, 1

[56] References Cited

U.S. PATENT DOCUMENTS

| | | | |
|---|---|---|---|
| 1,923,291 | 8/1933 | Zimmerer | 418/66 |
| 1,997,725 | 4/1935 | Gaede | 418/66 |
| 3,081,707 | 3/1963 | Marshall | 418/66 |
| 3,269,646 | 8/1966 | August | 418/66 |
| 4,585,404 | 4/1986 | Barata | 418/61.1 |
| 4,836,759 | 6/1989 | Lloyd | 418/56 |

FOREIGN PATENT DOCUMENTS

| | | |
|---|---|---|
| 371144 | 6/1930 | Belgium . |
| 575709 | 8/1924 | France . |
| 634042 | 2/1928 | France . |
| 61-46401 | 3/1986 | Japan . |
| 63-501373 | 5/1988 | Japan . |
| 4-63996 | 2/1992 | Japan . |
| 4-228894 | 8/1992 | Japan . |
| 5-202874 | 8/1993 | Japan . |

*Primary Examiner*—John J. Vrablik

[57] ABSTRACT

A swinging type blade which allows compressor reliability to be improved by preventing a blade from being fracture-damaged at its joint portion while reducing the compressors ineffective volume. A rotary compressor that adopts a swinging type blade including a swelling portion formed at the joint portion of the blade with a roller. Further, a recessed portion for receiving the swelling portion is provided in a swing bushing. Further, the swelling portion may be symmetrical relative to the blade or asymmetrical with an associated notch provided on the opposite side of the blade with respect to the asymmetrical swelling portion.

27 Claims, 6 Drawing Sheets

(Prior Art)

ROTARY COMPRESSOR HAVING STRENGTHENED PARTITION AND SHAPED RECESSES FOR RECEIVING THE STRENGTHENED PARTITION

TECHNICAL FIELD

The present invention relates to a rotary compressor primarily for use in a refrigerator.

BACKGROUND ART

Generally, a rotary compressor has a motor-driven compression member provided within a closed casing. This compression member comprises: a cylinder which has a cylinder chamber, and a suction port and a discharge port both opened to the cylinder chamber; a roller which is insertedly fitted to an eccentric shaft of a drive shaft extending from the motor and which revolves in the cylinder chamber along with rotation of the drive shaft; and a blade which is supported at an intermediate portion between the suction port and discharge port of the cylinder so as to be free to advance and retreat radially. The blade is so arranged that part of high-pressure gas discharged from the discharge port acts on its back face as back pressure, which back pressure in turn causes the tip of the blade to be always kept in contact with the outer peripheral surface of the roller. As a result, the interior of the cylinder chamber is partitioned into a low-pressure chamber communicating with the suction port and a high-pressure chamber communicating with the discharge port.

However, when the blade is supported to the cylinder so as to be free to advance and retreat, and has back pressure given on its back face side so that the tip of the blade is always kept in contact with the outer peripheral surface of the roller as described above, the contact portion between the blade and the outer peripheral surface of the roller is poorly fed with lubricating oil so as to be brought into metallic contact, during relative rotation of the roller and the blade. The result would be greater friction loss due to sliding resistance and therefore greater power loss, to a disadvantage. Further, high-pressure gas compressed in the high-pressure chamber may leak through the contact portion between the tip side of the blade and the roller into the low-pressure chamber. This would cause another problem that compression efficiency deteriorates.

Thus, the present inventor has before proposed a rotary compressor which can solve the above problems (Japanese Patent Application No. HEI 4-252750). Although this patent application has not been laid open yet, nor is it the prior art of the present invention, yet it is here described for an easier understanding of the present invention. The rotary compressor, as shown in FIG. 8, comprises a cylinder A having a cylinder chamber A1, and a roller C fitted to an eccentric shaft B1 of a drive shaft B and internally provided in the cylinder chamber A1. In the rotary compressor, a blade D is coupled with an outer peripheral portion of the roller C so as to protrude radially outward, while a retainer hole A5 of circular shape in cross section having an opening A4 opened to the cylinder chamber A1 is formed at an intermediate portion between a suction port A2 and a discharge port A3 both provided in the cylinder A. In this retainer hole A5 is provided a swinging bushing E which has a receptive groove E1 for receiving the protruding tip side of the blade D in such a way that the tip side of blade D is free to advance and retreat, and which is swingably retained to the cylinder A. In this arrangement, the protruding tip side of the blade D is inserted into the receptive groove E1 of the bushing E so as to be free to advance and retreat, whereby the interior of the cylinder chamber A1 is partitioned into a low-pressure chamber Y communicating with the suction port A2 and a high-pressure chamber X communicating with the discharge port A3. Besides, the blade D is inserted into the bushing E, whereby the roller C is non self-rotary type and operates along the inner peripheral surface of the cylinder chamber A1. It is noted that, in FIG. 8, reference character F denotes a valve plate disposed on the outer side of the discharge port A3 and G denotes a receptive plate of the valve plate F.

With the roller C in operation within the cylinder chamber A1 by the drive of the drive shaft B, the blade D coupled with the outer peripheral portion of the roller C is moved to advance and retreat with respect to the receptive groove E1 in accompaniment by the swing of the bushing E. By this operation, the interior of the cylinder chamber A1 is partitioned into the high-pressure chamber X and the low-pressure chamber Y. Gas fluid is sucked through the suction port A2 into the low-pressure chamber Y, while gas fluid compressed in the high-pressure chamber X is discharged through the discharge port A3 to the outside.

As described above, in the so-called swinging type blade in which the blade D is provided on the outer peripheral surface of the roller C so as to protrude radially outward and the protruding tip side of the blade D is inserted into the receptive groove E1 of the bushing E so as to be free to advance and retreat, the blade D and the roller C will not be moved relative to each other and the blade D will not be brought into contact with the outer peripheral surface of the roller C, either, unlike the conventional counterpart in which the protruding tip of the blade D is always kept in contact with the outer peripheral surface of the roller C. As a result, friction loss due to the contact between the roller C and the blade D can be suppressed so that power loss can be reduced. Yet, high-pressure gas in the high-pressure chamber X can be prevented from leaking through the contact surface between the blade D and the roller C into the low-pressure chamber Y, so that compressive efficiency can be improved.

However, according to the above-described arrangement, with the roller C in operation within the cylinder chamber A1, the tip side of the blade D protrusively provided on the outer peripheral surface of the roller C moves to advance and retreat within the receptive groove E1 of the bushing E, while the bushing E swingingly moves after the movement of the roller C within the retainer hole A5. As a result, when the roller C is operated, for example, clockwise in the figure, tensile stress in the direction of arrow Z in FIG. 8 concentrates on the low-pressure chamber Y side in the joint portion of the blade D to the roller C, while compressive stress concentrates on the high-pressure chamber X side in the joint portion of the blade D to the roller C. Due to this fact, the blade D has been easily fracture-damaged at the joint portion causing corresponding problems.

DISCLOSURE OF THE INVENTION

It is a primary object of the present invention to provide a rotary compressor which, despite the construction having a swinging type blade, can be improved in reliability by preventing the blade from being fracture-damaged at its joint portion to the roller and yet which can be improved in volumetric efficiency of the compressor by reducing ineffective volume on the high-pressure chamber X side.

To achieve the above object, according to the present invention, the rotary compressor includes: a cylinder 2 having a cylinder chamber 21; a roller 3 which is fitted to an eccentric shaft 61 of a drive shaft 6 and which is internally provided in the cylinder chamber 21; a blade 4 which is protrusively coupled with an outer peripheral portion of the roller 3 and which partitions the interior of the cylinder chamber 21 into a low-pressure chamber Y communicating with a suction port 22 and a high-pressure chamber X communicating with a discharge port 23; and a swinging bushing 5 which has a receptive groove 51 for receiving the protruding tip side of the blade 4 in such a way that the tip side of the blade 4 is free to advance and retreat, and which is swingably supported to a retainer hole 25 provided in the cylinder 2, characterized in that the rotary compressor further comprises a swelling portion 41 formed at the joint portion of the blade 4 to the roller 3, and a recessed portion 52 formed in the bushing 5 and for receiving the swelling portion 41.

Also, according to the present invention, the swelling portion 41 is formed on the high-pressure chamber side of the joint portion of the blade 4 to the roller 3, and the recessed portion 52 for receiving the swelling portion is provided on the high-pressure chamber side of the swinging bushing 5.

Further, according to the present invention, two swelling portions 41, 41 are formed in a pair on both the high-pressure chamber side and the low-pressure chamber side at the joint portion of the blade 4 to the roller 3, and the recessed portions 52, 52 for receiving the swelling portions 41, 41 are provided on both the high-pressure chamber side and the low-pressure chamber side of the swinging bushing 5.

Further, according to the present invention, the swinging bushing 5 comprises a pair of unitary bushes 5*a*, 5*b* having a semi-circular cross section, the receptive groove 51 is formed between opposite surfaces of the unitary bushes 5*a*, 5*b*. The unitary bushes 5*a*, 5*b* are provided with recessed portions 52 of identical shape, respectively, for receiving the swelling portion 41 formed at the joint portion of the blade 4.

Further, according to the present invention, the roller 3 has, on an outer peripheral portion opposite to the swinging bushing 5, a fitting groove 31 extending in parallel to the drive shaft 6. The blade 4 comprises an inserting portion 4*a* to be inserted into the receptive groove 51 in such a way that the inserting portion 4*a* is free to advance and retreat, a coupling portion 4*b* which is thicker than the inserting portion 4*a* and which is to be securely fitted to the fitting groove 31, and the swelling portion 41 formed between the inserting portion 4*a* and the coupling portion 4*b*.

According to the invention, the blade 4 is reinforced by the swelling portion 41 provided at the joint portion of the blade 4 to the roller 3 so that the blade 4 can be prevented from being fracture-damaged at its joint portion to the roller 3, despite its construction that the blade 4 is protrusively provided on an outer peripheral portion of the roller 3 and the protruding tip side of the blade 4 is inserted into the receptive groove 51 of the bushing 5 to freely advance and retreat. The swinging bushing 5 is provided with the recessed portion 52 for receiving the swelling portion 41. Therefore, when the roller 3 has reached the top dead center position during its operation within the cylinder chamber 21, i.e. when the tip side of the blade 4 is inserted deeply inside of the receptive groove 51 of the bushing 5 until the outer peripheral surface of the roller 3 is brought into contact with a portion of the inner wall surface of the cylinder chamber 21 opposite to the bushing 5, the swelling portion 41 provided at the joint portion of the blade 4 is inserted into the recessed portion 52 of the bushing 5 as shown in FIG. 6, for example. As a result, ineffective volume formed between the outer peripheral surface of the roller 3 and the bushing 5 in the top dead center position on the high-pressure chamber X side can be reduced, as compared to when the recessed portion 52 is not provided.

Accordingly, when the discharge stroke is finished and shifted to the suction stroke with the joint portion of the blade 4 reinforced, where suction gas is sucked into the low-pressure chamber y, high-pressure gas remaining in the ineffective volume can be suppressed from flowing back toward the low-pressure chamber Y to re-expand, so that the volumetric efficiency of the compressor will never deteriorate.

Also, according to the invention, the swelling portion 41 is formed on the high-pressure chamber X side at the joint portion of the blade 4 to the roller 3, and the recessed portion 52 for receiving the swelling portion 41 is provided on the high-pressure chamber X side of the bushing 5. As a result, compressive stress that acts on the blade 4 can be relieved by the swelling portion 41, so that the blade 4 can be effectively prevented from being fracture-damaged. Moreover, when the roller 3 has reached the top dead center position of the cylinder chamber 21 during its operation within the cylinder chamber 21, the swelling portion 41 of the blade 4 on the high-pressure chamber X side is inserted into the recessed portion 52 of the bushing 5, whereby ineffective volume formed between the outer peripheral surface of the roller 3 and the bushing 5 on the high-pressure chamber X side can be further lessened, while the joint portion of the blade 4 can be reinforced. Accordingly, the volumetric efficiency of the compressor can be improved in proportion.

Further, according to the invention as described in claim 3, a pair of swelling portions 41, 41 are formed on both the high-pressure chamber X side and the low-pressure chamber Y side at the joint portion of the blade 4 to the roller 3, and recessed portions 52, 52 for receiving the swelling portions 41, 41 are provided on both the high-pressure chamber X side and the low-pressure chamber Y side of the bushing 5. As a result, when the roller 3 has reached the top dead center position during its operation within the cylinder chamber 21, the swelling portions 41, 41 of the blade 4 on the high- and low-pressure chamber X and Y sides are inserted into the recessed portions 52, 52 of the bushing 5, respectively. Accordingly, ineffective volume formed between the outer peripheral surface of the roller 3 and the bushing 5 can be lessened so that the volumetric efficiency can be enhanced. At the same time, both compressive stress and tensile stress can be relieved by the swelling portions 41, 41, so that the blade 4 can be further reinforced. Thus, the rigidity of the joint portion of the blade 4 can be further enhanced by the two swelling portions 41, 41.

Further, according to the invention, the swinging bushing 5 is composed of a pair of unitary bushes 5*a*, 5*b* of semi-circular shape in cross section, the receptive groove 51 is formed between opposite faces of these unitary bushes 5*a*, 5*b*. Recessed portions 52 of identical shape for receiving the swelling portion 41 formed at the joint portion of the blade 4 are provided in the unitary bushes 5*a*, 5*b*. Therefore, the unitary bushes 5*a*, 5*b* can be formed into the same shape, making it possible to standardize component parts for common use. As a result, the machinability of the swinging bushing 5 can be improved while the unitary bushes 5*a*, 5*b* can be prevented from being mis-assembled.

Further, according to the invention, a fitting groove 31 is provided at an outer peripheral portion of the roller 5 opposite to the swinging bush 5 so as to extend axially, and a coupling portion 4*b* which is thicker than the inserting portion 4*a* of the blade 4 and which ranges to the inserting portion 4*a* via the swelling portion 41 is fitted to the fitting groove 31. As a result, the rigidity of not only the joint portion but also the coupling portion 4*b* can be enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

BEST MODE FOR CARRYING OUT THE INVENTION

Figure 1:
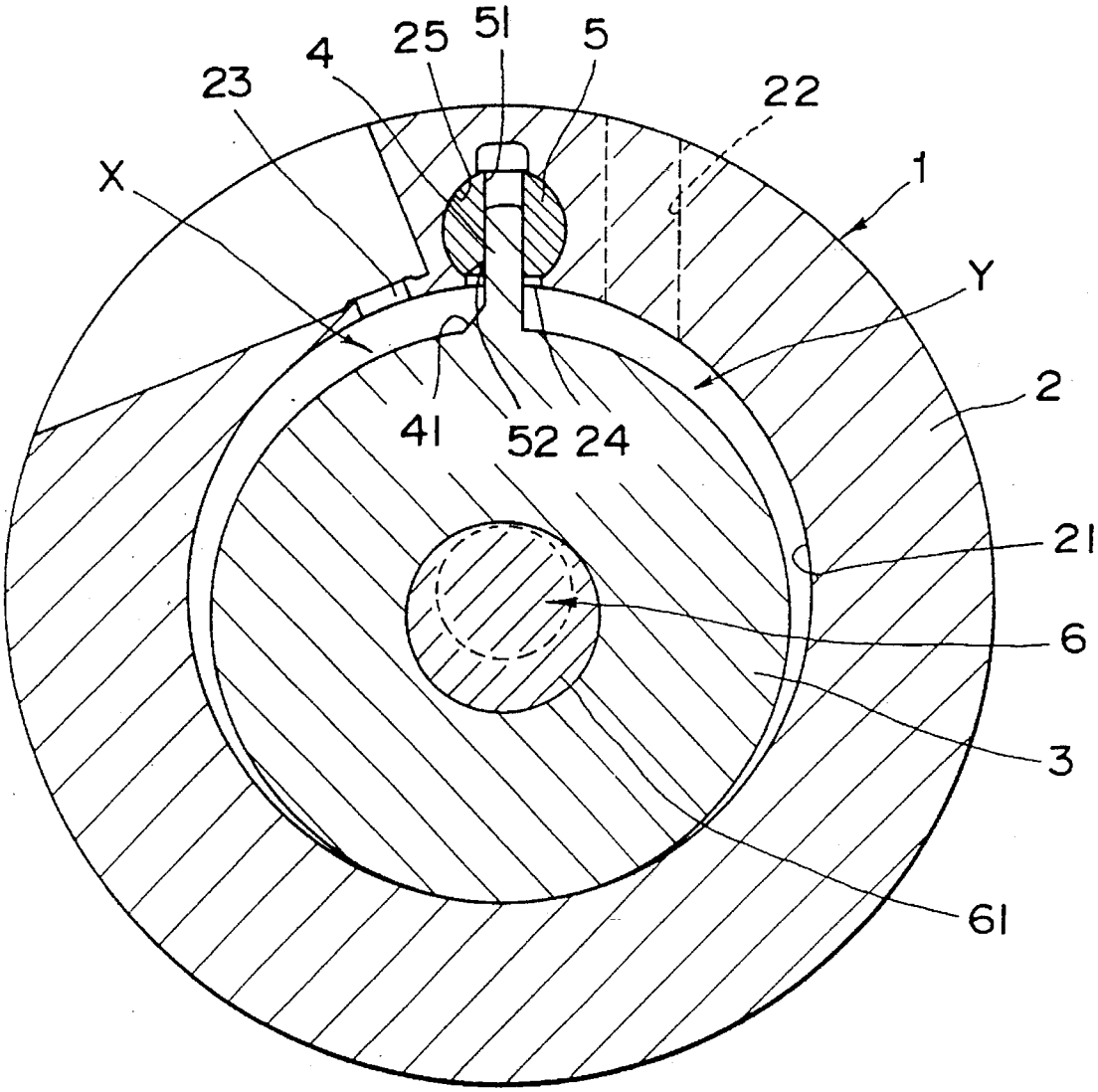
FIG. 1 is a plan view showing the main part of the rotary compressor according to the present invention.

FIG. 1 illustrates the cylinder part of the compression member in the rotary compressor. This compression member 1 comprises a cylinder 2 which has a cylinder chamber 21 in its inside and which is provided with a suction port 22 and a discharge port 23 both opened to the cylinder chamber 21, and a roller 3 internally fitted into the cylinder chamber 21. A blade 4 is formed at a portion of the outer periphery of the roller 3 integrally therewith so as to protrude radially outward.

Further, at an intermediate portion between the suction port 22 and the discharge port 23 of the cylinder 2 is formed a retainer hole 25, circular in cross section, having an opening 24 opened to the cylinder chamber 21. Further in the retainer hole 25 is provided a swinging bushing 5, which has a receptive groove 51 for receiving the protruding tip side of the blade 4 in such a way that the tip side of the blade 4 is free to advance and retreat, and which is swingably supported by the cylinder 2. By the protruding tip side of the blade 4 being inserted into the receptive groove 51 of the bushing 5 in such a way that the tip side of the blade 4 is free to advance and retreat, the interior of the cylinder chamber 21 is partitioned into a low-pressure chamber Y communicating with the suction port 22 and a high-pressure chamber X communicating with the discharge port 23. Furthermore, by the blade 4 being inserted into the bushing 5, the roller 3 is made not to rotate but to move along the inner peripheral surface of the cylinder chamber 21. It is noted that, in FIG. 1, reference numeral 6 denotes a drive shaft having its eccentric shaft 61 press fitted to the roller 3.

With the above-described arrangement, a swelling portion 41 is formed so as to be outwardly protuberant at the joint portion of the blade 4 to the roller 3 on at least one side of the high-pressure chamber X side and the low-pressure chamber Y side. Moreover, the bushing 5 is provided with a recessed portion 52 for receiving the swelling portion 41.

Figure 2:
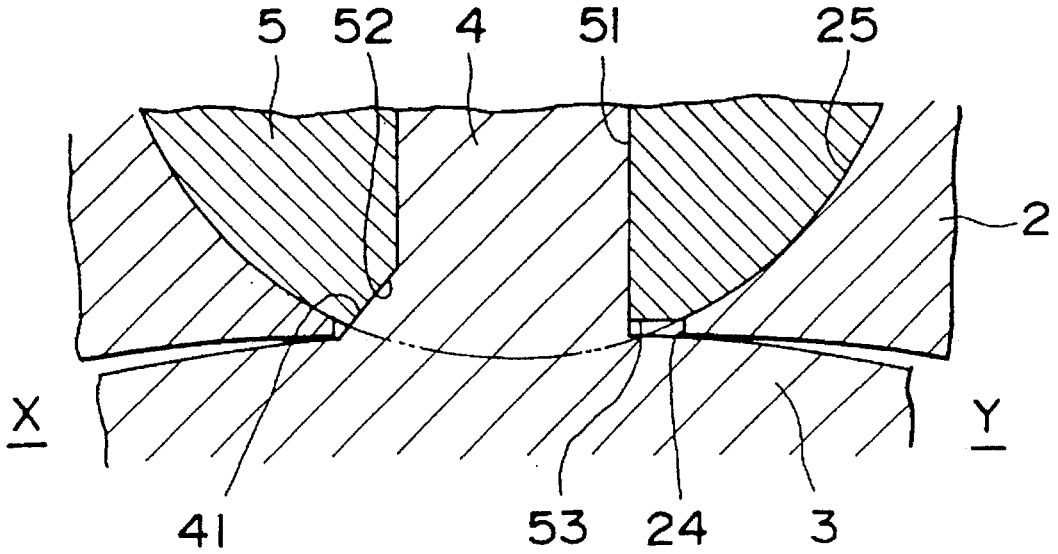
FIG. 2 is an enlarged cross-sectional view of the same main part.

In the actual case, as apparent from FIG. 2, in which the installing portion between the joint portion of the blade 4 and the bushing 5 is shown enlarged, the swelling portion 41 that is linearly protuberant over the range from a portion of the outer periphery of the roller 3 to the joint portion of the blade 4 is formed over the entire width of the blade 4 at the joint portion of the blade 4 to the roller 3 on the high-pressure chamber X side. Besides, the recessed portion 52 for receiving the swelling portion 41 is formed at a position of the bushing 5 opposite to the opening 24 of the retainer hole 25 on the high-pressure chamber X side.

Figure 3:
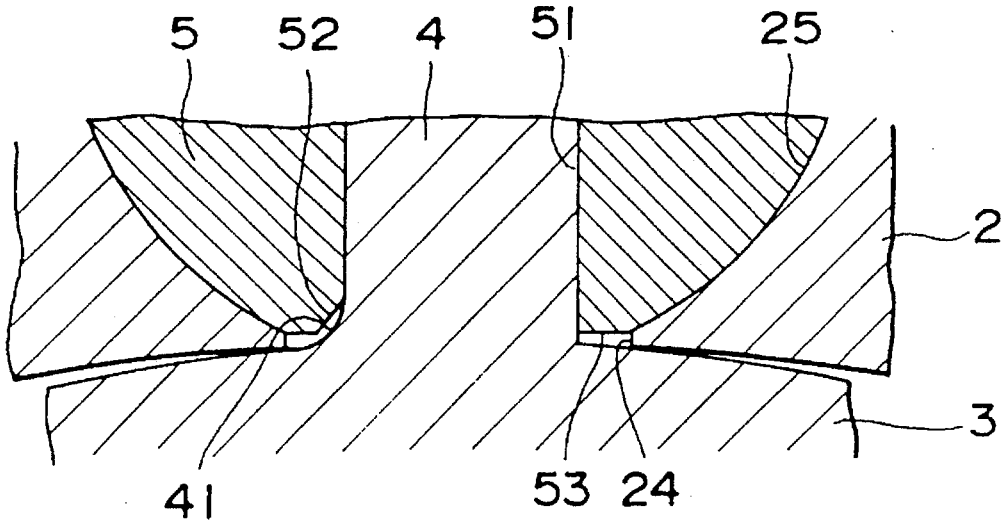
FIG. 3 is an enlarged cross-sectional view of the main part, showing another embodiment of the present invention.

Otherwise, the swelling portion 41 provided at the joint portion of the blade 4 may be shaped into a circular arc, as shown in FIG. 3.

With the above arrangement, the adoption of a swinging type blade 4 allows the various advantages as described before to be exhibited. Further, at the same time, the blade 4 can be reinforced by the swelling portion 41 provided at the joint portion of the blade 4 on the high-pressure chamber X side, so that the blade 4 can be prevented from being fracture-damaged at the joint portion to the roller 3. Yet, when the roller 3 has reached the top dead center position during its operation within the cylinder chamber 21, i.e., when the tip side of the blade 4 is inserted deeply inside of the receptive groove 51 of the bushing 5 until the outer peripheral surface of the roller 3 comes into contact with a position opposite to the bushing 5 on the inner wall surface of the cylinder chamber 21, the swelling portion 41 of the blade 4 is inserted into the recessed portion 52 of the bushing 5. Therefore, ineffective volume formed between the outer peripheral surface of the roller 3 and the bushing 5 in the top dead center position on the high-pressure chamber X side can be reduced. As a result, when the discharge stroke is finished and shifted to the suction stroke, where suction gas is sucked into the low-pressure chamber Y, high-pressure gas remaining in the ineffective volume can be prevented from flowing back toward the low-pressure chamber Y to re-expand. Accordingly, the volumetric efficiency of the compressor can be improved.

As described above, when the swelling portion 41 is provided at the joint portion of the blade 4 on the high-pressure chamber X side, and besides when the recessed portion 52 for receiving the swelling portion 41 is formed on the high-pressure chamber X side of the bushing 5, as shown in FIG. 2, it is preferable that a linear notch 53 is formed in the vicinity of the opening end of the receptive groove 51 on the low-pressure chamber Y side of the bushing 5 so as to extend along a line that connects a point of intersection between an oblique line forming the recessed portion 52 and an circular arc forming the profile of the bushing 5 with another point of intersection between a line forming the opening 24 on the low-pressure chamber Y side and the foregoing circular arc. The reason for this arrangement is as follows. When the recessed portion 52 is formed only on one side of the bushing 5 opposite to the high-pressure chamber X, and when a locus drawn from a point of the recessed portion 52 opposite to the opening 24 to a point of the bushing 5 on the low-pressure chamber Y side opposite to the opening 24 is shaped into a circular arc as indicated by imaginary line in FIG. 2, the roller 3, when having reached the top dead center position, is brought into contact with the arc portion of the bushing 5. Accordingly, the bushing 5 needs to be disposed radially outward with respect to the inner wall surface of the cylinder chamber 21. As a result, the clearance between the outer peripheral surface of the roller 3 and the bushing 5 could not be lessened due to the disposition of the bushing 5.

Figure 4:
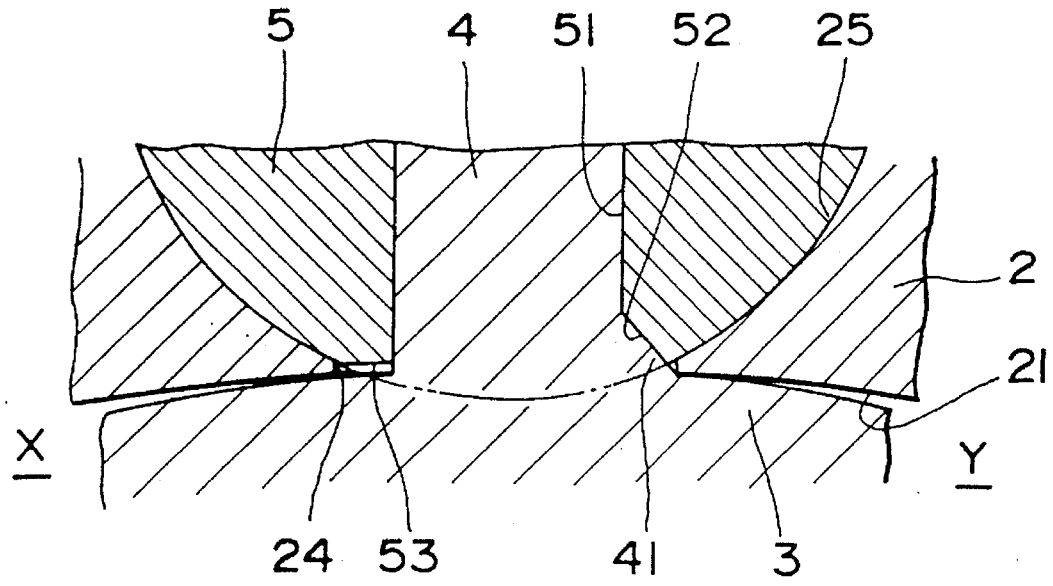
FIG. 4 is an enlarged cross-sectional view of the main part, showing still another embodiment of the invention.

Further, the swelling portion 41 may also be formed so as to be protuberant at the joint portion of the blade 4 to the roller 3 on the low-pressure chamber Y side, linearly from a portion of the outer periphery of the roller 3 to the joint portion of the blade 4, as shown in FIG. 4. In this case, the recessed portion 52 for receiving the swelling portion 41 is provided at a portion of the bushing 5 opposite to the opening 24 of the retainer hole 25 on the low-pressure chamber Y side.

Figure 5:
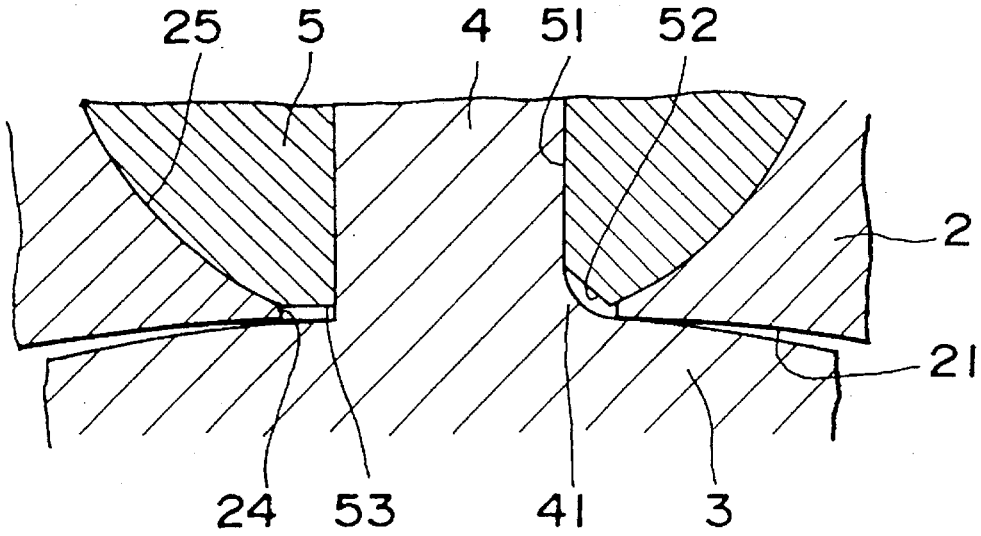
FIG. 5 is an enlarged cross-sectional view of the main part, showing still another embodiment of the invention.

Otherwise, the swelling portion 41 provided at the joint portion of the blade 4 on the low-pressure chamber Y side may be shaped into a circular arc, as shown in FIG. 5.

Thus, also with the arrangement of FIG. 4, the blade 4 is reinforced by the swelling portion 41 formed at the joint portion of the blade 4 on the low-pressure chamber Y side, as in the foregoing case. As a result, the blade 4 can be prevented from being fracture-damaged at its joint portion to the roller 3. Further, at the same time, when the roller 3 has reached the top dead center position during its operation within the cylinder chamber 21, the swelling portion 41 of the blade 4 is inserted into the recessed portion 52 of the bushing 5. Accordingly, ineffective volume formed between the outer peripheral surface of the roller 3 and the bushing 5 in the top dead center position and on the high-pressure chamber X side can be lessened as compared to a case where the recessed portion 52 is not provided.

As described hereinabove, when the swelling portion 41 is provided at the joint portion of the blade 4 on the low-pressure chamber Y side, and besides when the recessed portion 52 for receiving the swelling portion 41 is formed on the low-pressure chamber Y side of the bushing 5, it is preferable that a linear notch 53 is formed in the vicinity of the opening end of the receptive groove 51 on the high-pressure chamber X side of the bushing 5 so as to extend along a line that connects a point of intersection between an oblique line forming the recessed portion 52 and a circular arc forming the profile of the bushing 5 with another point of intersection between a line forming the opening 24 on the high-pressure chamber X side and the foregoing circular arc, as shown in FIG. 4. The reason for this arrangement is as follows. When the recessed portion 52 is formed only on the low-pressure chamber Y side of the bushing 5 as in the cases of FIGS. 2 and 3, and when a locus drawn from a point of the recessed portion 52 opposite to the opening 24 to a point of the bushing 5 on the high-pressure chamber X side opposite to the opening 24 is a circular arc as indicated by imaginary line in FIG. 4, the roller 3, when having reached the top dead center position, is brought into contact with the arc portion of the bushing 5. Accordingly, the bushing 5 needs to be disposed radially outward of the inner wall surface of the cylinder chamber 21. As a result, the clearance between the outer peripheral surface of the roller 3 and the bushing 5 could not be lessened due to the disposition of the bushing 5.

Figure 6:
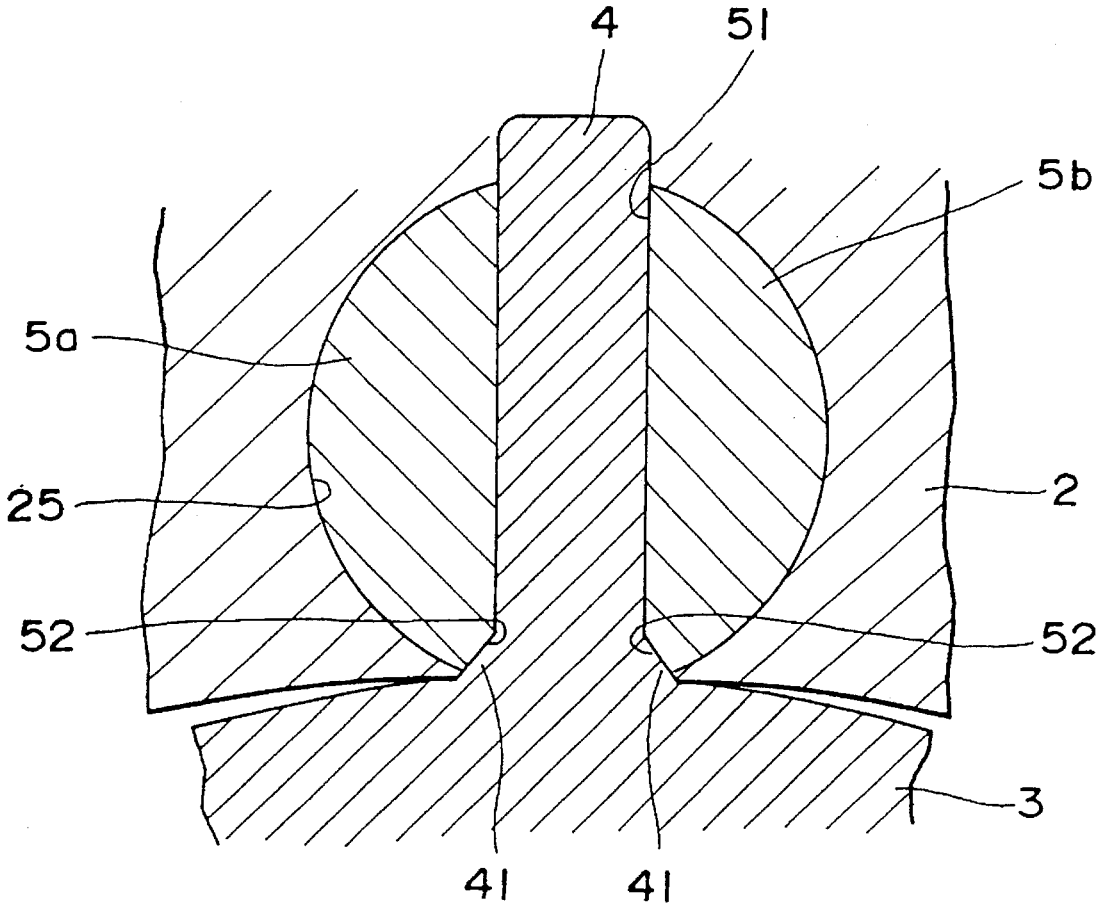
FIG. 6 is an enlarged cross-sectional view of the main part, showing still another embodiment of the invention.

Further, the swelling portion 41 may also be formed on both the high-pressure chamber X side and the low-pressure chamber Y side at the joint portion of the blade 4 to the roller 3, as shown in FIG. 6. In this case, recessed portions 52, 52 for receiving the swelling portions 41, 41 are provided on both the high-pressure chamber X side and the low-pressure chamber Y side of the bushing 5, respectively.

With the above arrangement, when the roller 3 has reached the top dead center position during its operation within the cylinder chamber 21, the swelling portions 41, 41 of the blade 4 on the high- and low-pressure chamber X, Y sides are inserted into the recessed portions 52, 52, respectively, of the bushing 5. As a result, ineffective volume formed between the outer peripheral surface of the roller 3 and the bushing 5 can be lessened so that the volumetric efficiency of the compressor can be improved. Further, at the same time, the blade 4 can be even more reinforced by the swelling portions 41, 41 so that the rigidity of the joint portion of the blade 4 can be further enhanced, with improved reliability.

Otherwise, the bushing 5 may be formed into a cylindrical shape having a receptive groove 51 with its one radial side opened to the cylinder chamber 21 and the other side closed. Moreover, the bushing 5 may also be formed of a pair of unitary bushes **5*a*, 5*b* of semi-circular shape in cross section as shown in FIG. 6, and a receptive groove 51 for receiving the protruding tip side of the blade 4 is formed between opposite faces of these unitary bushes 5*a*, 5*b*. Further, at one end of the unitary bushes 5*a*, 5*b* in the circular arc direction are provided recessed portions 52 of identical shape and for receiving the swelling portions 41 provided on the high- and low-pressure chamber sides at the joint portion of the blade 4, so that the unitary bushes 5*a*, 5*b* are supported by the retainer hole 25. By so doing, when the swelling portions 41 are provided on the high- and low-pressure chamber sides at the joint portion of the blade 4 as shown in FIG. 6, the receptive groove 51 and the recessed portion 52 can be easily formed in the swinging bushing 5, which is advantageous in its manufacturing process. Yet, since the unitary bushes 5*a*, 5*b* are of identical shape, component parts involved can be standardized for common use. Moreover, when the unitary bushes 5*a*, 5*b* are assembled symmetrically to the retainer hole 25 of the cylinder 2, the unitary bushes 5*a*, 5*b*** can be prevented from being mis-assembled, by virtue of their identical shape.

Figure 7:
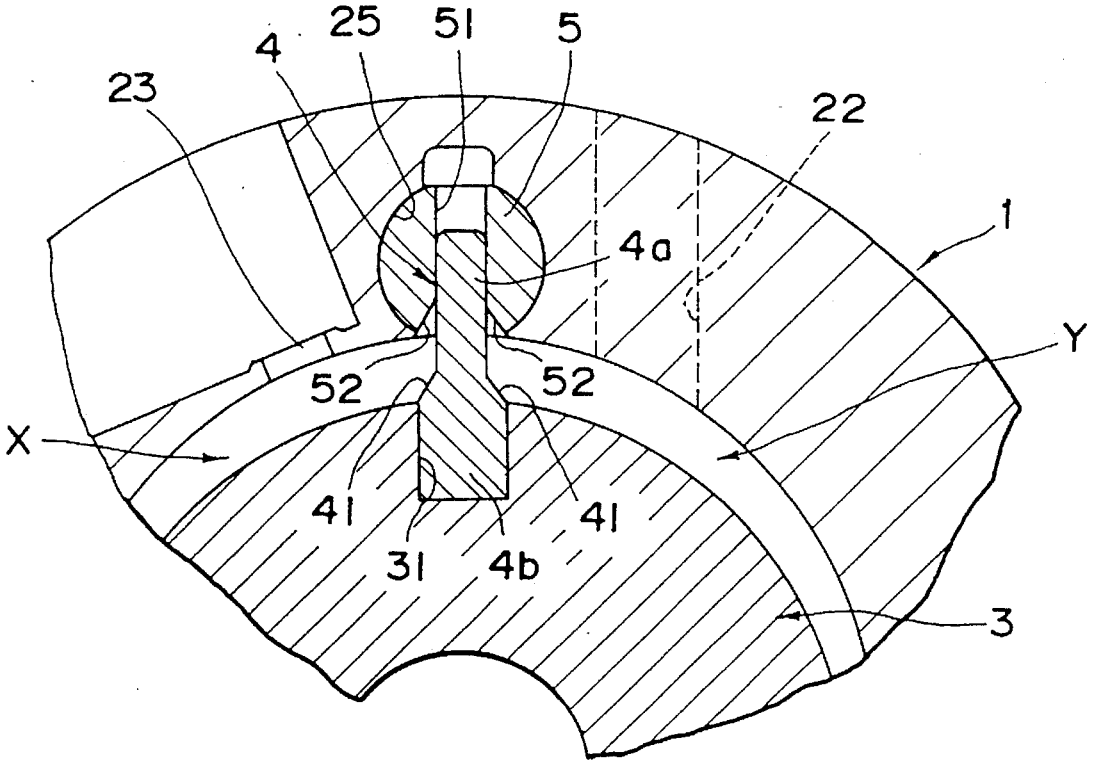
FIG. 7 is an enlarged cross-sectional view of the main part, showing still another embodiment of the invention.
Figure 8:
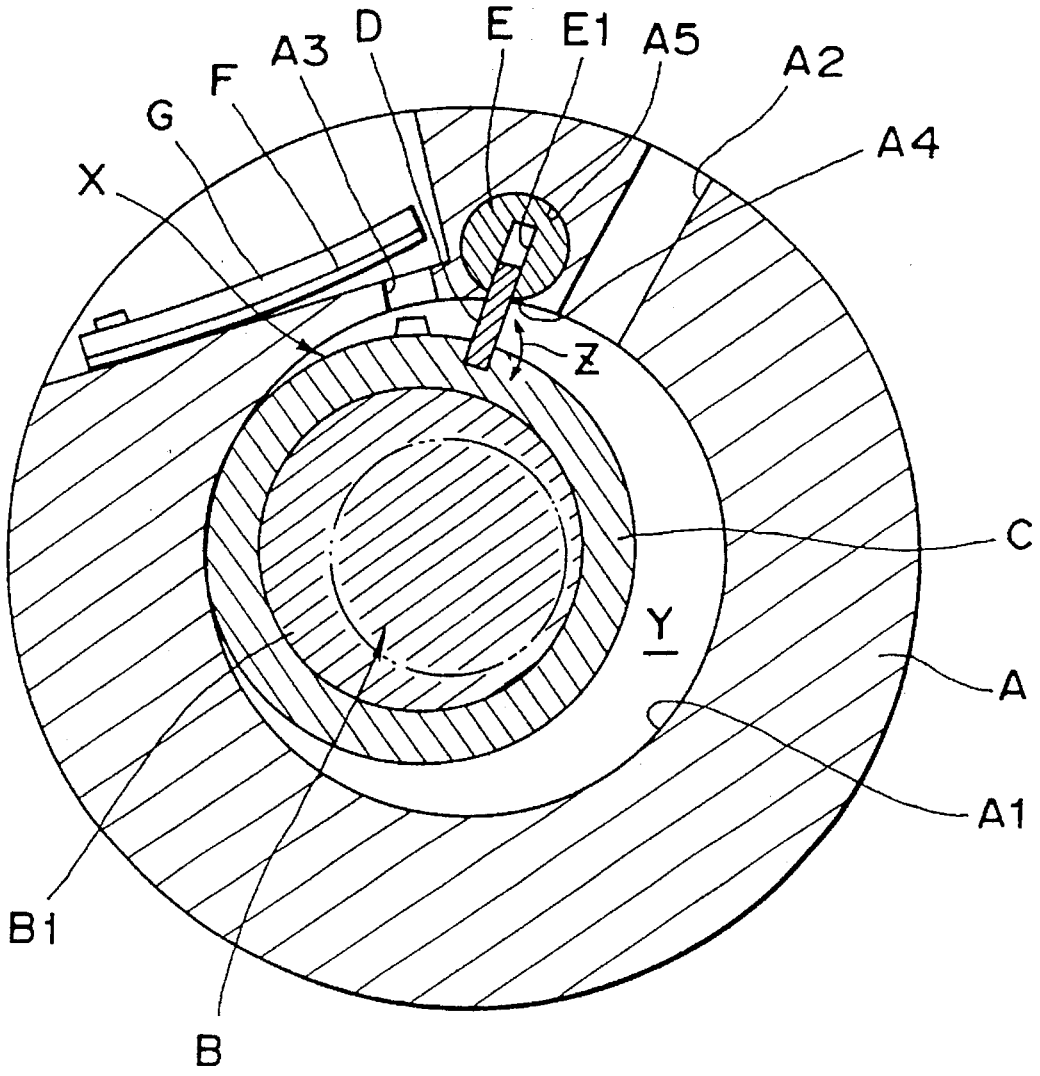
FIG. 8 is a cross-sectional view showing a conventional rotary compressor.

Although the above embodiments have been described taking the case where the blade 4 is protrusively formed integrally with part of the outer peripheral surface of the roller 3, yet the present invention of course can be applied to other cases where, for example, a fitting groove 31 extending in the axial direction is provided on the outer peripheral surface of the roller 3, as shown in FIG. 7, and the base side of the blade 4 is coupled with the fitting groove 31 in a buried state. In such a case, while the swelling portions 41 are formed at the joint portion of the blade 4 as shown in FIG. 7, the coupling portion **4*b* of the blade 4 with the fitting groove 31 is formed thicker than the inserting portion 4*a* to the receptive groove 51 so that not only the rigidity of the joint portion is enhanced, but also the rigidity of the coupling portion 4*b* with the fitting groove 31 is also enhanced. Further, when the blade 4 is formed independently of the roller 3, the swelling portion 41 may also be formed on only either one side of the high- or low-pressure chamber side, other than formed on both the high- and low-pressure chamber sides as shown in FIG. 7**.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A rotary compressor comprising a cylinder having a cylinder chamber; a roller fitted to an eccentric shaft of a drive shaft and internally provided in the cylinder chamber; a blade protrusively coupled with an outer peripheral portion of the roller and which partitions an interior of the cylinder chamber into a low-pressure chamber communicating with a suction port and a high-pressure chamber communicating with a discharge port; and a swinging bushing having a receptive groove receiving a protruding tip of the blade such that the tip of the blade is free to advance and retreat in the receptive groove, and which is swingably supported in a retainer hole provided in the cylinder, characterized in that the rotary compressor further comprises:

a swelling portion formed at a joint portion of the blade to the roller; and a recessed portion formed in the swinging bushing and receiving the swelling portion, the swelling portion substantially filling the recessed portion when the roller is at a top dead center position.

2. The rotary compressor as claimed in claim 1, wherein the roller includes, on an outer peripheral portion thereof opposite to the swinging bushing, a fitting groove extending in parallel to the drive shaft, and wherein the blade includes:

an inserting portion inserted into the receptive groove in such a way that the inserting portion is free to advance and retreat, a coupling portion thicker than the inserting portion and securely fitted to the fitting groove, and wherein the swelling portion is formed between the inserting portion and the coupling portion.

3. The rotary compressor as claimed in claim 1, further comprising:

a notch provided in the swinging bushing on the opposite side of the swinging bushing with respect to said recessed portion.

4. The rotary compressor as claimed in claim 1, wherein said swelling portion is formed on the high-pressure chamber side of the joint portion of the blade to the roller, and the recessed portion for receiving the swelling portion is provided on the high-pressure chamber side of the swinging bushing.

5. The rotary compressor as claimed in claim 4, wherein the roller includes, on an outer peripheral portion thereof opposite to the swinging bushing, a fitting groove extending in parallel to the drive shaft, and wherein the blade includes an inserting portion inserted into the receptive groove in such a way that the inserting portion is free to advance and retreat, a coupling portion thicker than the inserting portion and securely fitted to the fitting groove, and wherein the swelling portion is formed between the inserting portion and the coupling portion.

6. The rotary compressor as claimed in claim 4, wherein a segment of said swelling portion which contacts said recessed portion has a substantially linear shape.

7. The rotary compressor as claimed in claim 4, wherein a segment of said swelling portion which contacts said recessed portion has a circular arc shape.

8. The rotary compressor as claimed in claim 1, wherein said swelling portion is formed on the low-pressure chamber side of the joint portion of the blade to the roller, and the recessed portion for receiving the swelling portion is provided on the low-pressure chamber side of the swinging bushing.

9. The rotary compressor as claimed in claim 8, wherein the roller includes, on an outer peripheral portion thereof opposite to the swinging bushing, a fitting groove extending in parallel to the drive shaft, and wherein the blade includes an inserting portion inserted into the receptive groove in such a way that the inserting portion is free to advance and retreat, a coupling portion thicker than the inserting portion and securely fitted to the fitting groove, and wherein the swelling portion is formed between the inserting portion and the coupling portion.

10. The rotary compressor as claimed in claim 8, wherein a segment of said swelling portion which contacts said recessed portion has a substantially linear shape.

11. The rotary compressor as claimed in claim 8, wherein a segment of said swelling portion which contacts said recessed portion has a circular arc shape.

12. The rotary compressor as claimed in claim 1, wherein the swelling portions are formed in a pair on both the high-pressure chamber side and the low-pressure chamber side at the joint portion of the blade to the roller, and the recessed portions for receiving the swelling portions are provided on both the high-pressure chamber side and the low-pressure chamber side of the swinging bushing.

13. The rotary compressor as claimed in claim 12, wherein the roller has, on an outer peripheral portion thereof opposite to the swinging bushing, a fitting groove extending in parallel to the drive shaft, and the blade comprises an inserting portion to be inserted into the receptive groove in such a way that the inserting portion is free to advance and retreat, a coupling portion thicker than the inserting portion and securely fitted to the fitting groove, and the swelling portions formed between the inserting portion and the coupling portion.

14. The rotary compressor as claimed in claim 3, wherein the swinging bushing is composed of a pair of unitary bushes having a semi-circular cross section, the receptive groove is formed between opposite faces of the unitary bushes, and recessed portions of identical shape for receiving said swelling portions are provided in the unitary bushes.

15. In a rotary compressor having a cylinder with a cylinder chamber; a roller fitted to an eccentric shaft of a drive shaft and internally provided in the cylinder chamber; a blade protrusively coupled with an outer peripheral portion of the roller and which partitions an interior of the cylinder chamber into a low-pressure chamber communicating with a suction port and a high-pressure chamber communicating with a discharge port; and a swinging bushing having a receptive groove receiving a protruding tip of the blade such that the tip of the blade is free to advance and retreat in the receptive groove, and which is swingably supported in a retainer hole provided in the cylinder, a method for improving the durability of the blade and increasing compressor efficiency comprising the steps of:

providing a swelling portion on a joint portion of the blade to the roller; and providing a recessed portion formed in the swinging bushing for receiving the swelling portion, the swelling portion substantially filling the recessed portion when the roller is at a top dead center position.

16. The method of claim 15, further comprising the steps of:

providing a fitting groove extending in parallel to the drive shaft on an outer peripheral portion of the roller opposite to the swinging bushing, and constructing the blade to include an inserting portion inserted into the receptive groove in such a way that the inserting portion is free to advance and retreat and a coupling portion thicker than the inserting portion and securely fitted to the fitting groove, and forming the swelling portion between the inserting portion and the coupling portion.

17. The method of claim 15, further comprising the step of:

providing a notch in the swinging bushing on the opposite side of the swinging bushing with respect to the recessed portion.

18. The method of claim 15, further comprising the steps of:

providing the swelling portion on the high-pressure chamber side of the joint portion of the blade to the roller, and providing the recessed portion for receiving the swelling portion on the high-pressure chamber side of the swinging bushing.

19. The method of claim 18, further comprising the steps of:

providing a fitting groove extending in parallel to the drive shaft on an outer peripheral portion of the roller opposite to the swinging bushing, and constructing the blade to include an inserting portion inserted into the receptive groove in such a way that the inserting portion is free to advance and retreat and a coupling portion thicker than the inserting portion and securely fitted to the fitting groove, and forming the swelling portion between the inserting portion and the coupling portion.

20. The method of claim 18, further comprising the step of providing the swelling portion with a substantially linear shape which contacts the recessed portion.

21. The method of claim 18, further comprising the step of providing the swelling portion with a circular arc shaped segment which contacts the recessed portion.

22. The method of claim 15, wherein the swinging bushing is composed of a pair of unitary bushes having a semicircular cross section and further comprising the steps of:

providing the swelling portion on both the high pressure chamber side and the low-pressure chamber side of the joint portion of the blade to the roller, providing the receptive groove between opposite faces of the unitary bushes, and providing recessed portions that receive the swelling portions in the unitary bushes.

23. The method of claim 22, further comprising the steps of:

providing a fitting groove on an outer peripheral portion of the roller opposite to the swinging bushing and extending in parallel to the drive shaft;

providing the blade with an inserting portion to be inserted into the receptive groove in such a way that the inserting portion is free to advance and retreat; and providing the blade with a coupling portion thicker than the inserting portion and securely fitted to the fitting groove, wherein the swelling portions are provided between the inserting portion and the coupling portion of the blade.

24. The method of claim 15, further comprising the steps of:

forming the swelling portion on the low-pressure chamber side of the joint portion of the blade to the roller, and providing the recessed portion for receiving the swelling portion on the low-pressure chamber side of the swinging bushing.

25. The method of claim 24, further comprising the steps of:

providing a fitting groove extending in parallel to the drive shaft on an outer peripheral portion of the roller opposite to the swinging bushing, and constructing the blade to include an inserting portion inserted into the receptive groove in such a way that the inserting portion is free to advance and retreat and a coupling portion thicker than the inserting portion and securely fitted to the fitting groove, and forming the swelling portion between the inserting portion and the coupling portion.

26. The method of claim 24, further comprising the step of providing the swelling portion with a substantially linear shape which contacts the recessed portion.

27. The method of claim 24, further comprising the step of providing the swelling portion with a circular arc shaped segment which contacts said recessed portion.

* * * * *